US005458955A

United States Patent [19]

Vaughn et al.

[11] Patent Number: 5,458,955

[45] Date of Patent: Oct. 17, 1995

[54] METAL/POLYMER LAMINATES HAVING AN ANIONOMERIC POLYMER FILM LAYER

[75] Inventors: George D. Vaughn, Chesterfield; Patrick J. Kinlen, Fenton, both of Mo.

[73] Assignee: Monsanto Company, St. Louis, Mo.

[21] Appl. No.: 140,340

[22] Filed: Oct. 21, 1993

[51] Int. Cl.[6] ..... B32B 9/00

[52] U.S. Cl. ..... 428/212

[58] Field of Search ..... 428/212; 96/35.1

[56] References Cited

U.S. PATENT DOCUMENTS

| | | | |
|---|---|---|---|
| 3,900,320 | 8/1975 | Rolker et al. | 96/35.1 |
| 4,433,082 | 2/1984 | Grot | 524/755 |
| 4,818,365 | 4/1989 | Kinlen et al. | 204/433 |
| 4,910,072 | 3/1990 | Morgan et al. | 428/212 |
| 5,082,734 | 1/1992 | Vaughn | 428/411.1 |

FOREIGN PATENT DOCUMENTS

| | | | |
|---|---|---|---|
| 0079218 | 5/1983 | European Pat. Off. | C25B 13/00 |
| 0066369 | 8/1985 | European Pat. Off. | C08L 27/18 |
| 58-883030 | 5/1983 | Japan | C08J 5/22 |
| 61-87887 | 5/1986 | Japan | C25B 11/20 |

OTHER PUBLICATIONS

Martin, et al., *Anal. Chem.*, 1982, 54,1639–1641; Dissolution of Perfluorinated Ion Containing Polymers.

Moore et al. *Macromolecules*, 1988, 21, 1334–1339.

'Study Of The Optimal Structure Of A Solid Polymer Electrolyte For Water Electrolysis' (Panchlor S.p.A. Rpt.).

*Primary Examiner*—Partick J. Ryan
*Assistant Examiner*—Kam F. Lee
*Attorney, Agent, or Firm*—Thomas E. Kelley

[57] ABSTRACT

Metal/polymer laminates prepared from essentially insoluble anionomeric polymer film layer with catalytic metal, e.g. palladium, exchanged into surface acid groups which can be reduced to provide catalytic metal clusters for catalyzing electroless deposition of metal which is resistant to removal by adhesive tape. Anionomeric polymer films are coated from solutions, emulsions or dispersions of sulfonated or carboxylated polyesters or sulfonated, phosphonated or carboxylated perfluorocarbon polymer, dried and heat treated, e.g. at 120°–180° C., to render the coating insoluble.

5 Claims, No Drawings

METAL/POLYMER LAMINATES HAVING AN ANIONOMERIC POLYMER FILM LAYER

Disclosed herein are metal/polymer laminates, having an anionomeric polymer film layer, prepared by electroless deposition on a catalytic metal surface of the anionomeric polymer film layer and methods of making and using such laminates.

BACKGROUND

The electroless deposition of metals onto substrates, e.g. polymeric thermoplastic or elastomeric substrates, is often achieved by first sensitizing the substrate to electroless deposition by application of a catalytic material, e.g. a palladium colloid or complex. A common deficiency of laminates comprising electrolessly deposited metal on plastic substrates is poor adhesion of the metal layer to the polymeric substrate, resulting from the poor adhesion of the sensitizing catalyst. Consequently, attempts to improve adhesion of electrolessly deposited metal layers is often focused on improving the adhesion of the catalytic material to the polymeric substrate, e.g. by using acid, base or solvent to etch or swell the surface. Such techniques often do not provide satisfactory adhesion, for instance, because substrate surfaces tend to degrade when treated with acid, base or solvent or because the substrate surface is resistant to such treatment.

Another method, e.g. providing films having catalytic metal particles incorporated into a polymeric binder, generally provides metal coatings of poor quality in terms of appearance and adhesion.

Still another method of providing substrates with adherent catalytic surfaces capable of providing substantially adhering metal layers of high quality involves the catalytic activation of inert polymer films prepared from solutions of catalytic metal, e.g. palladium, and polymer. Morgan et al. in U.S. Pat. No. 4,910,072 disclose such films prepared from organic solvents; an environmental disadvantage of such films is the high volume of organic solvent that is generated in producing such films. More environmentally advantageous are the catalytic films disclosed by Vaughn in U.S. Pat. No. 5,082,734; for instance, catalytic films are prepared from water soluble polymers, e.g. cellulose derivative polymers and polyvinyl alcohol, and aqueous emulsions of polymers. A disadvantage of such films comprising water soluble polymers is poor adhesion to selected substrates, e.g. polyurethane.

The polymer films used in this invention utilize sulfonated perfluorocarbon polymers; such polymers are commonly fabricated into Nafion® cation permeable membranes available from E.I. du Pont de Nemours & Company for use in electrochemical devices such as fuel cells, batteries, and other applications requiring cation permeability. For such membrane applications it is common to provide metal coatings, e.g. as electrodes, on the membrane surface. Various methods for applying metal coatings to sulfonated perfluorocarbon polymer membranes are disclosed in the Final Report by Panclor, S.p.A., Milan, Italy to the Commission of the European Communities, Directorate-General for Research, Science and Education, entitled "Study of the Optimal Structure of a Solid Polymer Electrolyte For Water Electrolysis" (Contract No 703 -79-1-EHI). Panclor's methods for the deposition of nickel onto sulfonated perfluorocarbon polymer membranes include: (a) treating with sodium sulfide and then nickel sulfate to form a nickel sulfide conductive layer onto which nickel is electroplated; (b) treating with tin chloride and then silver nitrate and formaldehyde to form a silver layer onto which nickel is electroplated; and (c) treating with tin chloride and then palladium chloride and sodium hypophosphite to form a palladium layer onto which nickel is electrolessly deposited. The latter method is reported to have provided better quality nickel electrodes in terms of electrochemical performance and durability as determined by a bending test and thermocycle test.

Fujita et al. in Japanese Kokai Patent Publication Sho 61[1986]-87887 discloses the preparation of electrodes on Nafion® sulfonated perfluorocarbon polymer membranes. An electrode is formed on one surface of the membrane by electroless plating of rhodium. An electrode is formed on the other surface of the membrane by hot pressing a mixture of black platinum powder, sulfonated styrene-divinylbenzene resin powder, an alcohol solution of Nafion® sulfonated perfluorocarbon polymer and a suspension of polytetrafluoroethylene.

Kiyoya et al. in Japanese Kokai Patent Publication Sho 58[1983]-83030 discloses providing electrodes on perfluorocarbon polymer ion exchange membranes by impregnating a sulfonated surface with a platinum salt, reducing with sodium borohydride and then electrolessly depositing platinum.

Because it is difficult to adhere such membranes to substrates and because the metal coatings are generally porous, e.g. to accommodate fluid flow through the membrane, laminates of metal coated sulfonated perfluorocarbon polymer membranes are not particularly useful for applying metal coatings onto other substrates.

Sulfonated perfluorocarbon polymers have also been used to provide thin coatings onto articles. See Grot's disclosure in U.S. Pat. No. 4,433,082 of sulfonated perfluorocarbon polymer solutions which are useful to repair damaged membranes and provide ion exchange coatings. According to Moore et al., *Macromolecules,* 1988, 21, 1334–1339, films of solution-cast sulfonated perfluorocarbon polymers exhibit different physical and chemical properties than commercial membranes; for instance, the solution-cast films are not as pliant and mechanically strong and are also brittle and highly soluble. Moore et al. attribute these poor properties to a lack of crystallinity in the polymer film. Crystallinity can be imparted into the polymer film by changing the solvent from which films are cast or by heat treatment, e.g. above the matrix polymer glass transition temperature (about 140° C. for sodium forms of the ionic polymer). See also Kinlen et al. who disclose in U.S. Pat. No. 4,818,365 procedures for coating electrodes with cation permeable coatings of perfluorosulfonic acid polymer which include dipping electrodes in solutions of the polymer and low boiling point solvents, such as water and lower alkyl alcohols, evaporating the solvent at less than 120° C., and then annealing the polymer coating preferably at a temperature of about 180°–230° C.

An object of this invention is to provide catalytic films that allow the electroless deposition of strongly adhering metal layers on substrates without acid, base or solvent treatment of the substrate surface.

Another object of this invention is to provide catalytic films using environmentally acceptable solvents, e.g. water, alcohols and mixtures thereof.

SUMMARY OF THE INVENTION

We have discovered that strongly adhering metal layers can be electrolessly deposited onto a variety of substrates including substrates having substantially hydrophobic surfaces, e.g. metal oxide surfaces or hydrophobic polymeric surfaces, by employing an intermediate, adhesive, catalytic layer comprising an anionomeric polymer. Such catalytic polymer layers can be prepared from a liquid medium solution, emulsion or dispersion of such polymer having sulfonate, phosphonate or carboxylate acid groups. After the liquid medium is evaporated, the dry polymer coating is preferably heated to provide resistance to water solubility. Metal ions are incorporated into acid groups at the surface of the polymer and reduced to permit catalyzation of electroless deposition. Preferred anionomeric polymers include sulfonated or carboxylated polyester, sulfonated, phosphonated or carboxylated perfluorocarbon polymer, or a mixture thereof. Especially preferred anionomeric polymers include sulfonated or carboxylated perfluorocarbon polymers having the structural formula:

$$-(CF_2-CF_2)_x\cdots(CF_2-\underset{\substack{|\\(O-CF_2\underset{\substack{|\\O-(CF_2)_n-A}}{C}FCF_3)_m}}{CF})_y-$$

where A is a sulfonate or carboxylate group, the ratio of x/y is 5 to 12, m is 0 or 1, and n is 1 to 5.

This invention also provides laminates comprising a thin film of essentially water insoluble anionomeric polymer between a substrate and an electrolessly deposited layer of strongly adherent metal.

DETAILED DESCRIPTION OF PREFERRED EMBODIMENTS

The metal-polymer laminates of this invention comprise a thin film, e.g. less than 5 micrometers thick, of anionomeric polymer between a substrate and an electrolessly deposited layer of metal. The substrate can be any polymeric material or an inorganic material such as a ceramic material. The methods of this invention are especially advantageous in preparing metal laminates on fluorocarbon substrates, e.g. polytetrafluoroethylene film commonly known as Teflon (a registered trademark of E.I. dupont deNemours and Company) and porous, expanded polytertrafluoroethylene membranes commonly known as Gore-tex (a registered trademark of W. L. Gore & Associates, Inc.). In such laminates the anionomeric polymer is essentially water insoluble at standard atmospheric pressure and 25° C. and has sulfonate, phosphonate or carboxylate groups adapted to ionically incorporate metal which can catalyze the electroless deposition of metal, e.g. copper. In such laminates a preferred anionic polymer is a sulfonated or carboxylated polyester, a sulfonated, phosphonated or carboxylated perfluorocarbon polymer, or a mixture thereof. An especially preferred anionomeric polymer is a sulfonated polyester, e.g. available as water dispersions from Eastman Chemical Company as AQ 55S sulfonated polyester. An even more preferred anionomeric polymer is a sulfonated or carboxylated perfluorocarbon polymer having the structural formula:

$$-(CF_2-CF_2)_x\cdots(CF_2-\underset{\substack{|\\(O-CF_2\underset{\substack{|\\O-(CF_2)_n-A}}{C}FCF_3)_m}}{CF})_y-$$

where A is a sulfonate or carboxylate group, the ratio of x/y is 5 to 12, m is 0 or 1, and n is 1 to 5. Carboxylated perfluorocarbon polymer is available in water/alcohol solutions from Asahi Glass Company, Ltd. as Flemion® perfluorocarboxylate polymer solution. Sulfonated perfluorocarbon polymer is available in water/alcohol solutions from Solution Technology, Inc. as Nafion® perfluorosulfonated ionomer solution. Solutions of sulfonated perfluorocarbon polymers can also be prepared as disclosed in European Patent Publications 0 066 369 and 0 079 218, U.S. Pat. No. 4,391,844, and by Martin et al., *Anal. Chem,* 1982, 54, 1639–1641, which are incorporated herein by reference.

The laminates of this invention can be prepared coating a substrate with a film of an anionomeric polymer from a liquid medium solution, emulsion or dispersion of such an anionomeric polymer having sulfonate, phosphonate or carboxylate acid groups. Coating may be applied by a variety of methods, such as painting, printing, spraying, dipping or spin-coating and the like. The liquid medium is evaporated, e.g. at ambient or elevated temperature, to provide a dry coating of anionomeric polymer on the substrate. The dry polymer coating is heated to provide resistance to water solubility. For instance, in the case of dispersions, heating effects coalescence of polymeric particles into a coherent film. In the case of emulsions and/or solutions, heating effects interaction and aggregation of hydrophilic and hydrophobic domains in the polymer coating. Depending on the anionomeric polymer such heat treatment can be at a temperature up to the glass transition temperature of the polymer, e.g. in the range of 120° to 180° C., for sufficient time to render the polymer essentially water insoluble. The polymer should be sufficiently water insoluble to retain its integrity when immersed in aqueous electroless plating solutions, e.g. having pH in the range of 5 to 12. Preferably, especially in the case of perfluorocarbon anionomeric polymers, the heat treatment is for sufficient time to allow acid groups to orient into domains at the surface thereof. In some cases when using perfluorocarbon anionomeric polymers, it is advantageous to dry the film, i.e. evaporate the liquid medium, and heat the polymer concurrently, e.g. at a temperature up to about 120° C. for at least about 30 minutes.

Ions of metals capable of catalyzing electroless deposition are incorporated into acid groups on the surface of the polymer and reduced to metal ions to metal clusters. Such metal ions, include palladium, copper, nickel, silver and the like, most preferably palladium. Such reduction can be effected by treating the metal ion-containing surface with a reducing agent, e.g. a solution of sodium hypophosphite or caustic formaldehyde is appropriate for reducing palladium ions while a stronger reducing agent such as a borohydride solution is typically needed to reduce copper or nickel ions. Reduction can be effected prior to or simultaneously with electroless deposition. Electroless deposition can be effected from any of the well-known electroless deposition plating solutions for metals such as copper, nickel, cobalt, palladium and the like. With adequate heat treatment a strongly adhering metal layer can be electrolessly deposited onto the anionomeric polymer layer to provide the laminates of this invention. Preferably, the metal is so strongly adhered as to be resistant to removal by adhesive tape.

The following examples serve to illustrate certain embodiments and aspects of this invention and are not intended to imply any limitation of the scope of the invention.

EXAMPLE 1

This example serves to illustrate the use of sulfonated perfluorocarbon polymer to provide metalpolymer laminates with strongly adhering electrolessly-deposited copper.

A casting solution containing 1% by weight sulfonated perfluorocarbon polymer was prepared by adding ethanol to a 5% solution of Nafion 1100 EW perfluorosulfonated ionomer obtained from Solution Technology, Inc. The casting solution was coated onto strips of polyethylene terephthalate (PET) film using a 25 micrometer film applicator. After the liquid medium was evaporated in air, the dry, coated films were placed in an oven for 10 minutes at temperatures ranging from 120°–200 ° C. After heating the films were immersed for 30 seconds in a palladium acetate solution (0.72% palladium) prepared by adding 0.30 g palladium acetate to a stirred solution of 24 ml acetonitrile and 6 ml water to exchange palladium ions for hydrogen ions in the sulfonate groups. The films were then rinsed with copious amounts of tap water followed with deionized water and then plated with copper by immersion for 2.5 minutes in an electroless copper-depositing bath containing 5.8 g/L formaldehyde, 2.9 g/L copper, and 0.087 M EDTA and maintained at about pH 11.5 and 35° C. The quality of adhesion of the copper layer was evaluated by tape peel tests using Scotch Brand Magic Transparency Tape. The quality of the electrolessly-deposited copper is reported in Table 1.

EXAMPLE 2

The procedure of the above Example 1 was essentially repeated except that the casting solutions were prepared to contain 1.5% by weight sulfonated perfluorocarbon polymer and the palladium-containing films were immersed in the electroless copper-depositing bath for 2 minutes. The quality of the electrolessly-deposited copper is reported in Table 1.

EXAMPLE 3

This example serves to illustrate the use of sulfonated polyester to provide metal-polymer laminates with strongly adhering electrolessly-deposited copper. The procedure of the above Example 1 was essentially repeated except a 2 weight percent anionomeric polymer dispersion was prepared by adding water to 28 weight percent dispersions of AQ 55S sulfonated polyester dispersion obtained from Eastman Chemical Company. Films coated with dispersions of 2 weight percent of the anionomeric dispersions were immersed for 1 minute in the palladium sulfate solution (0.7% palladium, 0.38N sulfuric acid) and for 2.5 minutes in the electroless copper-depositing bath. The quality of the electrolessly-deposited copper reported in Table 1 was evaluated by attempting to remove the plated metal with adhesive tape, e.g. Highland™ 6200 permanent mending tape from Minnesota Mining & Manufacturing Company.

TABLE 1

QUALITY OF PLATED COPPER/TAPE TEST RESULTS

| Heating Oven | Anionomer-containing solutions | | |
|---|---|---|---|
| Temperature | 1% | 1.5% | 2% |
| 120° C. | M | M | |
| 130 | G/N | G/N | |
| 140 | G | G | |
| 160 | G/N | G/N | G/N |
| 180 | G/S | G/N | |
| 200 | G/F | G/F | |

G = good quality copper plate
M = marginal quality copper plate
N = no copper removed by tape TABLE 1-continued

QUALITY OF PLATED COPPER/TAPE TEST RESULTS

| Heating Oven | Anionomer-containing solutions | | |
|---|---|---|---|
| Temperature | 1% | 1.5% | 2% |

S = some copper removed by tape
F = most copper removed by tape

EXAMPLE 4

This example illustrates laminates according to this invention comprising electrolessly deposited metal on Teflon® polytetrafluoroethylene film. Two separate films (4×5 cm) were sandblasted using aluminum oxide grit (number 3 from S. S. White Industrial) to clean and roughen the surface. The roughened films were dipped into a 1% Nafion sulfonated perfluorocarbon polymer solution (prepared as in Example 1), then placed vertically to dry. Both films were heated for 10 minutes—one at 160° C. (Film A) and the other at 180° C. (Film B); immersed for 30 seconds in a palladium acetate solution (0.72% palladium); rinsed with water; then immersed in an electroless copper plating bath (MaCuDep 1000 copper bath from MacDermid) at 35° C. Copper adhesion was tested using Highland™ 6200 adhesive tape. Adhesive tape removed more than 80% of the copper from Film A but less than 1% from Film B.

EXAMPLE 5

This example illustrates laminates according to this invention comprising electrolessly deposited metal on Gore-tex® porous, expanded polytetrafluoroethylene film membrane. A 1% Nafion® sulfonated perfluorocarbon polymer solutions (prepared as in Example 1) was coated onto a layer of the membrane mounted on a filter funnel. Solvent was evaporated by drawing a vacuum on the funnel and blowing nitrogen onto the membrane. The dried membrane was heated for 10 minutes at 160° C.; immersed for 30 seconds in a palladium acetate solution (0.72% palladium); rinsed with water; then immersed for 5 minutes in an electroless copper plating bath (MaCuDep 1000 copper bath from MacDermid) at 35° C. The copper coated membrane was electrically conductive across the surface and through the membrane. Copper adhesion was tested using Highland™ 6200 adhesive tape. Adhesive tape tore the membrane but did not remove copper.

While specific embodiments have been described herein, it should be apparent to those skilled in the art that various modifications thereof can be made without departing from the true spirit and scope of the inventions. Accordingly, it is intended that the following claims cover all such modifications within the full inventive concept.

What is claimed is:

1. A metal-polymer laminate comprising a thin film of anionomeric polymer between a substrate and an electrolessly deposited layer of metal, wherein said anionomeric polymer is less than 5 micrometers thick, is essentially water insoluble at standard atmospheric pressure and 25° C. and has sulfonate, phosphonate or carboxylate groups adapted to ionically incorporate metal which can catalyze the electroless deposition of copper; and wherein said metal is resistant to removal by adhesive tape.

2. A laminate according to claim 1 wherein said anionic polymer is a sulfonated or carboxylated polyester, a sulfonated, phosphonated or carboxylated perfluorocarbon polymer, or a mixture thereof.

3. A laminate according to claim 2 wherein said perfluorocarbon polymer has the structural formula:

$$-(CF_2-CF_2)_x\cdots(CF_2-\underset{\underset{(O-CF_2\underset{\underset{O-(CF_2)_n-A}{|}}{C}FCF_3)_m}{|}}{C}F)_y-$$

where A is $-SO_3H$ or $-COOH$ or a salt thereof, the ratio of x/y is 5 to 12, m is 0 or 1, and n is 1 to 5.

4. A metal-coated polytetrafluoroethylene article comprising a layer of a sulfonated, phosphonated or carboxylated perfluorocarbon polymer between a polytetrafluoroethylene substrate and a metal coating.

5. An article according to claim 4 wherein said substrate is porous, expanded polytetrafluoroethylene film and said layer comprises sulfonated perfluorocarbon polymer.

* * * * *